US007669639B2

(12) United States Patent
Whealy et al.

(10) Patent No.: US 7,669,639 B2
(45) Date of Patent: Mar. 2, 2010

(54) MOLDING AND DIE CASTING APPARATUS AND METHODS

(75) Inventors: Gregg E. Whealy, Losantville, IN (US); Ryan A. Haas, Fishers, IN (US); William R. Garrett, Muncie, IN (US); Brian L. Backus, Albany, IN (US)

(73) Assignee: Delaware Machinery and Tool Co., Inc., Muncie, IN (US)

( * ) Notice: Subject to any disclaimer, the term of this patent is extended or adjusted under 35 U.S.C. 154(b) by 664 days.

(21) Appl. No.: 11/497,217

(22) Filed: Aug. 1, 2006

(65) Prior Publication Data

US 2007/0204969 A1 Sep. 6, 2007

Related U.S. Application Data

(60) Provisional application No. 60/779,249, filed on Mar. 3, 2006.

(51) Int. Cl.
*B22D 17/26* (2006.01)
*B22D 33/04* (2006.01)

(52) U.S. Cl. ..... 164/340; 164/341

(58) Field of Classification Search ..... 164/137, 164/340, 341, 342

See application file for complete search history.

(56) References Cited

U.S. PATENT DOCUMENTS

| | | | | |
|---|---|---|---|---|
| 3,165,796 | A | 1/1965 | McDonald | |
| 3,433,292 | A | 3/1969 | McDonald | |
| 3,596,708 | A | 8/1971 | Lapin | |
| 4,206,799 | A | 6/1980 | McDonald | |
| 4,981,168 | A | 1/1991 | Koch et al. | |
| 5,204,127 | A | 4/1993 | Prusha | |
| 5,323,840 | A * | 6/1994 | Usui et al. | 164/332 |
| 5,338,171 | A | 8/1994 | Hayakawa et al. | |
| 5,429,175 | A | 7/1995 | Thieman et al. | |
| 5,551,864 | A | 9/1996 | Boskovic | |
| 5,865,241 | A | 2/1999 | Bishenden et al. | |
| 6,761,208 | B2 * | 7/2004 | Whealy et al. | 164/340 |
| 7,278,462 | B2 * | 10/2007 | Purdy et al. | 164/312 |
| 7,500,508 | B2 * | 3/2009 | Heinrich et al. | 164/312 |

* cited by examiner

*Primary Examiner*—Kevin P Kerns
(74) *Attorney, Agent, or Firm*—Brinks Hofer Gilson & Lione

(57) ABSTRACT

A mold, or die is easily and conveniently maintainable, includes releasably retained parts and permits access and removal of mold parts or elements that may need maintenance, repair or replacement without removal of the mold or die from a die casting machine.

18 Claims, 6 Drawing Sheets

MOLDING AND DIE CASTING APPARATUS AND METHODS

This patent application claims the benefit of U.S. Provisional Patent Application No. 60/779,249, filed Mar. 3, 2006.

FIELD OF THE INVENTION

This invention relates generally to molding and die casting apparatus and methods. The invention particularly relates to such apparatus including portions that may need frequent maintenance, repair or replacement, including, for example, mold elements intended to define cavities, channels, and openings within a cast or molded article.

More particularly, this invention relates to die casting apparatus, dies and die parts for casting V-block internal combustion engines, and methods and apparatus for their maintenance, repair and replacement. The terms "mold" and "die" and "molding" and "die casting" are used interchangeably in this patent application in referring to apparatus and methods in which articles of manufacture are formed in cavities from a liquefied solid.

BACKGROUND OF THE INVENTION

Many molds or dies include movable die parts adapted to define channels, holes, or other openings within articles molded in the mold. The mold or die parts reciprocate or otherwise move between each molding or casting cycle to permit release of the molded article. Upon occasion, an element of the mold or die part fails or wears so that the molded or cast article no longer conforms to its intended design, thus mandating the repair or replacement of the mold or die part, or one or more of the elements forming the mold or die part. Such failure or wear can mandate that the entire mold or die be removed from the molding or die casting machine for disassembly and repair.

Dies and methods for die-casting V-block engines are well-known, and have been the subject of a number of patents as shown by U.S. Pat. Nos. 3,165,796; 3,433,292; 3,596,708; 4,206,799; 4,981,168; 5,204,127; 5,338,171; 5,429,175; 5,551,864; 5,865,241; and 6,761,208.

For example, U.S. Pat. No. 5,865,241 (the '241 Patent), discloses a die for casting a V-block for an internal combustion engine on a casting machine having a stationary platen and a movable platen. The die disclosed by the '241 patent includes, in addition to a die part on the stationary platen, two additional die parts, a central movable die part and a movable die part is mounted on the movable platen of the die casting machine. The central movable die is mounted on the movable platen of the die casting machine. The central movable die part movably carries a pair of die parts (frequently referred to as "slides") that are movable along axes that are generally perpendicular to the direction of movement of the movable platen, and a pair of cylinder-forming die parts that are movable at acute angles with respect to the direction of movement of the movable platen, along intersecting axes, so that the cylinder-forming die parts may be moved from retracted positions within the central movable die part to positions extending within the cavity formed by the die where they may be fitted with sleeves to form the cylinders of an internal combustion engine V-block when the cavity is filled with molten metal. After the cylinder-forming die parts are moved into their extended positions, a pair of double-acting hydraulic cylinders, connected between the central movable die part and the movable die part mounted on the movable platen, move the central movable die part into engagement with the movable die part mounted on the movable platen and thereby move a forward surface of the movable die part mounted on the platen into engagement with rear surfaces of the extended cylinder-forming die parts to restrain their rearward movement during casting. The movable platen then carries the movable die parts of the die into a cavity-forming engagement with the stationary die part, and the extended cylinder-forming parts are held in their extended positions, notwithstanding the forces imposed on the cylinder-forming die parts as the cavity is filled with molten metal under extremely high pressures.

Another die example is disclosed in U.S. Pat. No. 6,761,208 (the '208 patent). The V-block casting die disclosed by the '208 patent includes a stationary die part mounted on a stationary platen of a die-casting machine, and only one movable die part mounted on the movable platen of the die-casting machine. The movable die part carries a pair of transversely moving slides that are movable along axes that are generally perpendicular to the direction of movement of the movable platen, and a pair of cylinder-forming die parts that are movable at acute angles along intersecting axes, so that the cylinder-forming die parts may be extended from retracted positions within the movable die part to positions extending within the V-block forming cavity where they may be fitted with sleeves to form the V-block cylinders during casting. In the die disclosed in the '208 patent, the cylinder-forming die parts are locked in their extended positions by locking means carried within the movable die part, and movable into engagement with rear surfaces of the extended cylinder-forming die parts to lock the cylinder-forming die parts in their extended positions, notwithstanding the forces imposed on the cylinder-forming die parts as the cavity is filled with molten metal under extremely high pressures.

Wherever this description refers to cylinder-forming die, or mold, parts or cylinder-forming die core parts, the references refer to those die, or mold, elements that move at an acute angle with respect to the direction of movement of the die casting machine and can carry and position cylinder-forming die, or mold, elements in a V-block casting cavity and/or can carry and position cylinder-forming and water jacket-forming die elements in a V-block casting cavity and can otherwise form the cylinders of a V-block casting.

The '241 and '208 patents disclose two die approaches in use in casting internal combustion engine V-blocks. In both approaches, the movable cylinder-forming die parts of the dies can include two portions. Central cylindrical cylinder-forming die pieces, sometimes referred to mandrels, onto which the sleeves forming the interior surfaces of the cylinders of the internal combustion engine are placed prior to casting, and water jacket-forming die pieces with portions extending adjacent, but spaced from, and frequently at least partially surrounding, the cylinder-forming die pieces, to provide the walls of the internal combustion engine block surrounding its cylinders with coolant passages.

In production, the dies for forming V-block internal combustion engines can produce 20 to 40 blocks per hour, frequently for 24 hours a day, substantially every day of the year. Because of their high use and the high forces, temperatures and pressures to which the dies are exposed, it is not uncommon that they need frequent maintenance, and the repair and replacement of die parts, particularly the cylinder-forming and water jacket-forming die pieces. The forward portions of the water jacket-forming die pieces, for example, can comprise projecting thin wall cylinders which are subjected to the high temperature and high pressure of the molten metal and the high stresses they create within their forwardly extending thin wall cylinder portions, and the water jacket-forming die pieces frequently require repair or replacement if a die assembly is to continue to form acceptable internal combustion engine blocks, and their failures can cause a shut-down in the operation of a V-block die and the manufacture of V-block castings.

Removal of a massive movable die assembly from the die casting machine requires the use of a high-capacity overhead crane. Many engine plants have only one overhead crane with sufficient capacity to lift and move the massive movable die part, which can weigh as much as 90 tons, and the demand for the use of the high-capacity overhead crane can result in long down times in order to repair or replace die parts. Thus, repair and replacement of cylinder-forming die parts and elements can cause lengthy interruptions in the casting and manufacture of internal combustion engine V-blocks.

BRIEF SUMMARY OF THE INVENTION

The invention can provide a mold, or die that can be easily and conveniently maintainable and permit access and removal of mold parts or elements that may need maintenance, repair or replacement without removal of the mold or die from a die casting machine.

A mold or die can include, for example, a mold element removably retained within a part of the mold. One such removably retained mold element can include a distal portion adapted to form a feature in molded products formed in the mold, such as an internal combustion engine cylinder, and an enlarged proximal portion having a first surface facing the distal portion. The mold part can include a first opening to receive the removably retained mold element and a second opening arranged generally transversely to the first opening to receive a locking element. The locking element is engageable with the first surface of the removably retained mold element and can be movable within the second opening between a retracted position, permitting release of the mold element from the mold part, and a locking position adapted to engage the first surface of the mold element proximal portion to retain the mold element within the mold part. A suitable moving means can be provided for moving the locking element within the second opening between the retracted position and the locking position to permit removal of the mold element while the mold is retained in a molding machine. One such locking element can comprise a yoke adapted to straddle a portion of the removably retained mold element between the distal and proximal portions. The yoke may be movably carried between its locking and retracted positions within the mold part, which can be, for example, a slide means for extending the mold element into the mold cavity, and the mold element of the mold part can be removably retained in position by the yoke in the mold part while the mold part is still retained in the mold on the molding machine. A movement of the yoke between its locking and retracted positions can be accomplished by one or more threaded rods accessible from outside of the mold part. Upon withdrawal of the locking element from a locking position to a release position, the mold element of the mold part needing repair or replacement can be withdrawn from the mold part while the mold is still retained in the molding or machine. The mold element can then be repaired, or replaced; the repaired or replaced mold element can be inserted into the mold part; and the locking element moved to the locking position where it secures the mold element within the mold part. The locking element for a removably retained mold element can comprise, however, any movable or removable element, that can engage and interconnect the removably retained mold element and a mold part.

Another such mold or die can comprise a die for casting an internal combustion engine V-block in a die casting machine having a stationary platen and a movable platen, including a stationary die part for mounting on the stationary platen of the die casting machine, and a movable die part for mounting on the movable platen of the die casting machine, the movable die part carrying least a pair of removably retained cylinder-forming die parts that are movably carried within first openings of the movable die part for reciprocation at an acute angle with respect to the direction of movement of the movable platen between a first position extending into the die cavity and a second position retracted within the movable die part. The removably retained cylinder-forming die parts can comprise, for example, interconnected cylinder-forming die pieces and water jacket-forming die pieces removable as units and retained in the movable die part by a movable or removable pins. The cylinder-forming and water jacket-forming die parts may, for example, be interconnected by engaged forwardly facing and rearwardly facing surfaces or by other interconnecting means. In addition, the cylinder-forming die pieces and water jacket-forming die pieces can include cooling means to reduce the temperatures of the parts.

Other features and advantages of the invention will be apparent to those skilled in the art from the drawings and more detailed description that follows.

BRIEF DESCRIPTION OF THE DRAWINGS

FIG. 3 illustrates a rear portion of the cylinder-forming die part and the means for removably retaining the cylinder-forming die part in the movable bank slide part of the mold, with the surrounding portions of the movable bank slide omitted;

FIG. 4 illustrates a rear part of the cylinder-forming die part and the means for removably retaining the cylinder-forming mold element in the mold, with adjacent portions of the movable bank slide part shown in lightened outline;

DETAILED DESCRIPTION OF THE INVENTION

The drawings, FIG. 1-FIG. 7, illustrate several embodiments of the invention of this patent application, which provide facility in the maintenance and repair of molds and dies and in the replacement of broken and worn mold and die parts.

Figure 1:
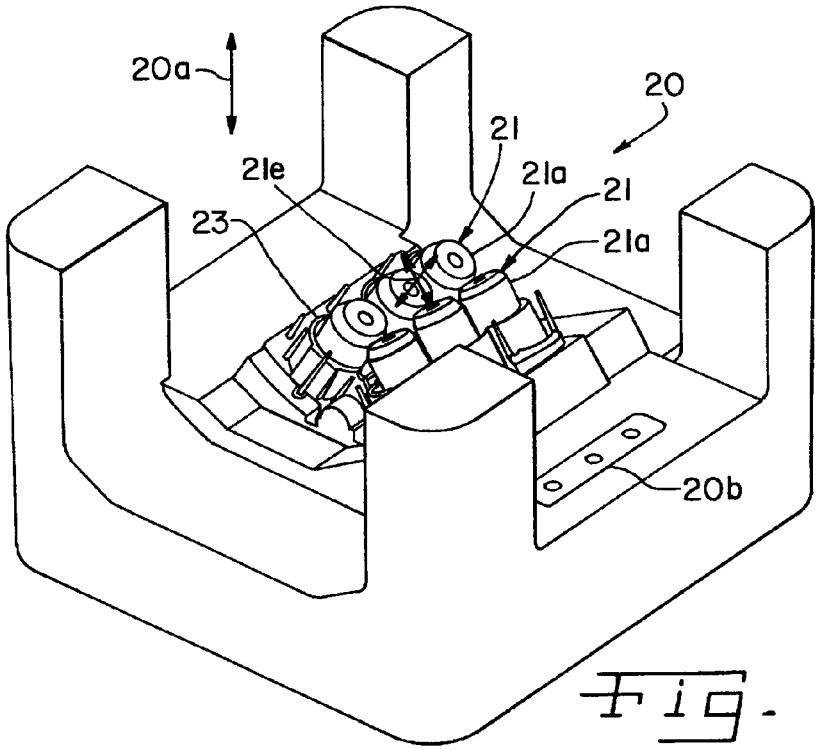
FIG. 1 is a perspective view of a part of a mold including the invention for molding a six-cylinder engine block.

FIG. 1-FIG. 5 show an embodiment of the invention in a series of perspective and break away drawings. FIG. 1, for example, shows in a perspective view one part 20 of a mold for die casting a V-block for an internal combustion engine. The mold part 20 illustrated in FIG. 1 is frequently referred to in the casting art as an "ejection holder" and is generally mounted to the movable die, which is carried by the movable platen of the die casting machine. As illustrated in FIG. 1, the mold part 20 carries mold elements 21, which are its cylinder-forming die parts, the ends 21*a* of which are shown in the position in which they would extend into the cavity formed by the mold when its stationary mold part and slides (not shown) and the movable mold part 20 are closed.

The end portions 21*a* of the mold element 21 carry cylinder sleeves in the mold cavity and form the cylinders of an internal combustion engine V-block. The cylinder-forming mold parts 21 are carried by the mold part 20 for reciprocation at acute angles (shown by arrows 21*e* in FIG. 1) with respect to the direction of movement of the mold part 20 (shown by arrow 20*a* in FIG. 1) when mounted on the movable die. Because the cylinder-forming mold elements 21 are exposed to the harsh conditions of die casting, including the high temperature of molten metals, for example, over 1100° F. for aluminum, the high forces resulting from the high injection pressures of the molten metal, for example, 10000-20000 psi, and the high forces imposed on the parts in operation of the mold, cylinder-forming mold elements 21 frequently need maintenance, repair and replacement. As set-forth more fully below, the mold elements 21 are removably retained in the mold part 20 in a manner permitting their easy removal from the mold part 20 without its removal from the movable die.

FIGS. 2-5 illustrate cylinder-forming die parts 21 of the mold part 20 of FIG. 1 and their means for movably retaining the cylinder-forming die parts 21 in the mold part 20.

Figure 2:
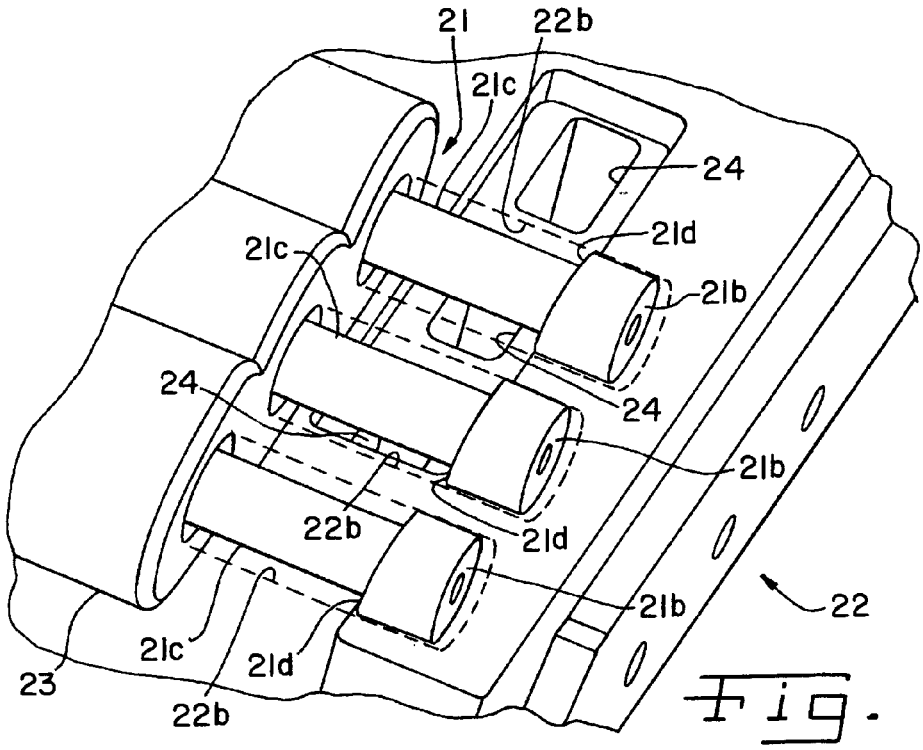
FIG. 2 is a partial perspective view of a portion of the mold part illustrated in FIG. 1 with the structure of the movable bank slide part surrounding the cylinder-forming die part broken away and shown in lightened outline only to display the cylinder-forming die part in darkened print.
Figure 3:
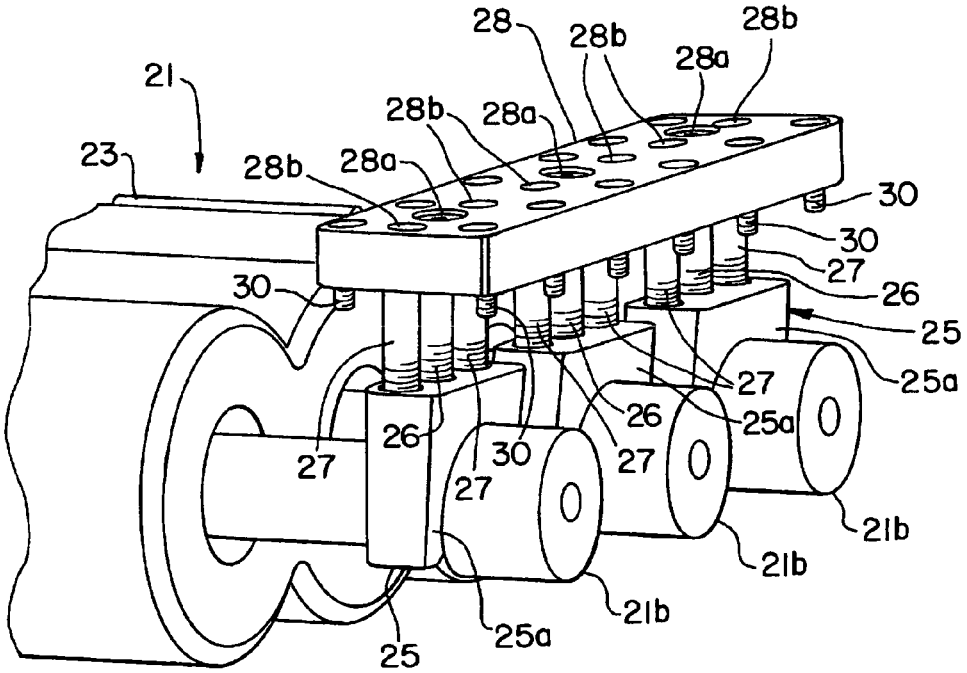
FIGS. 3 and 4 are perspective views of the cylinder-forming die part and the means for removably retaining it in the mold part of FIG. 1.
Figure 5:
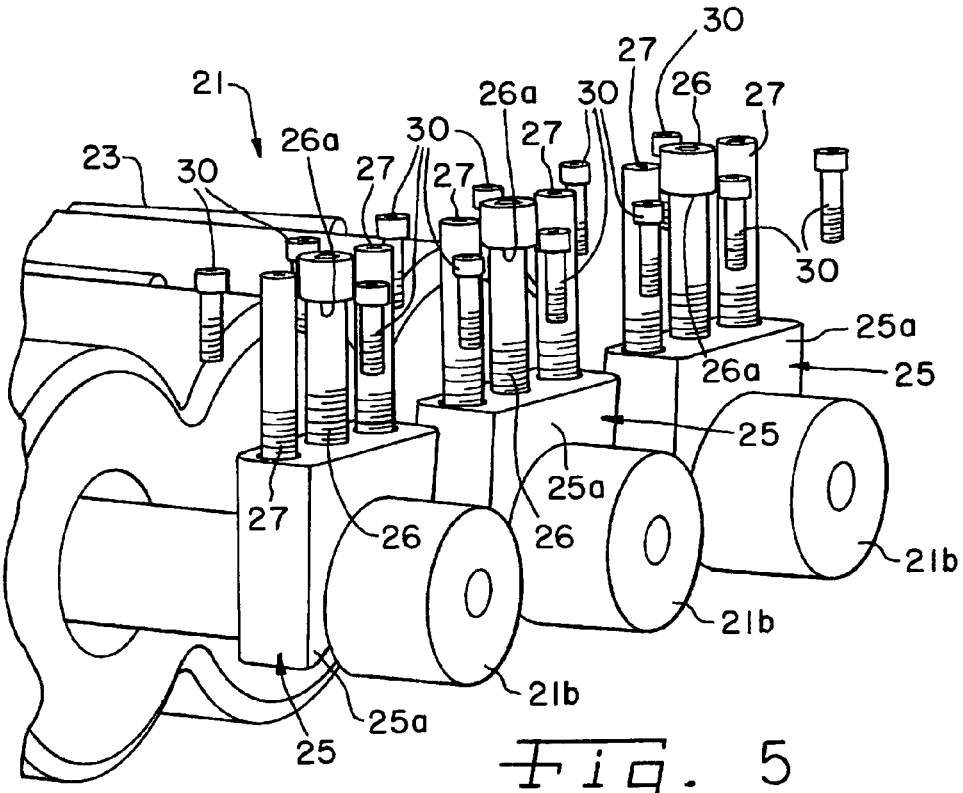
FIG. 5 corresponds to FIG. 3 without a showing of the screw-retaining cover plate to show the various rods of the means for removably retaining the cylinder-forming die part in the movable bank slide part of the mold.
Figure 4:
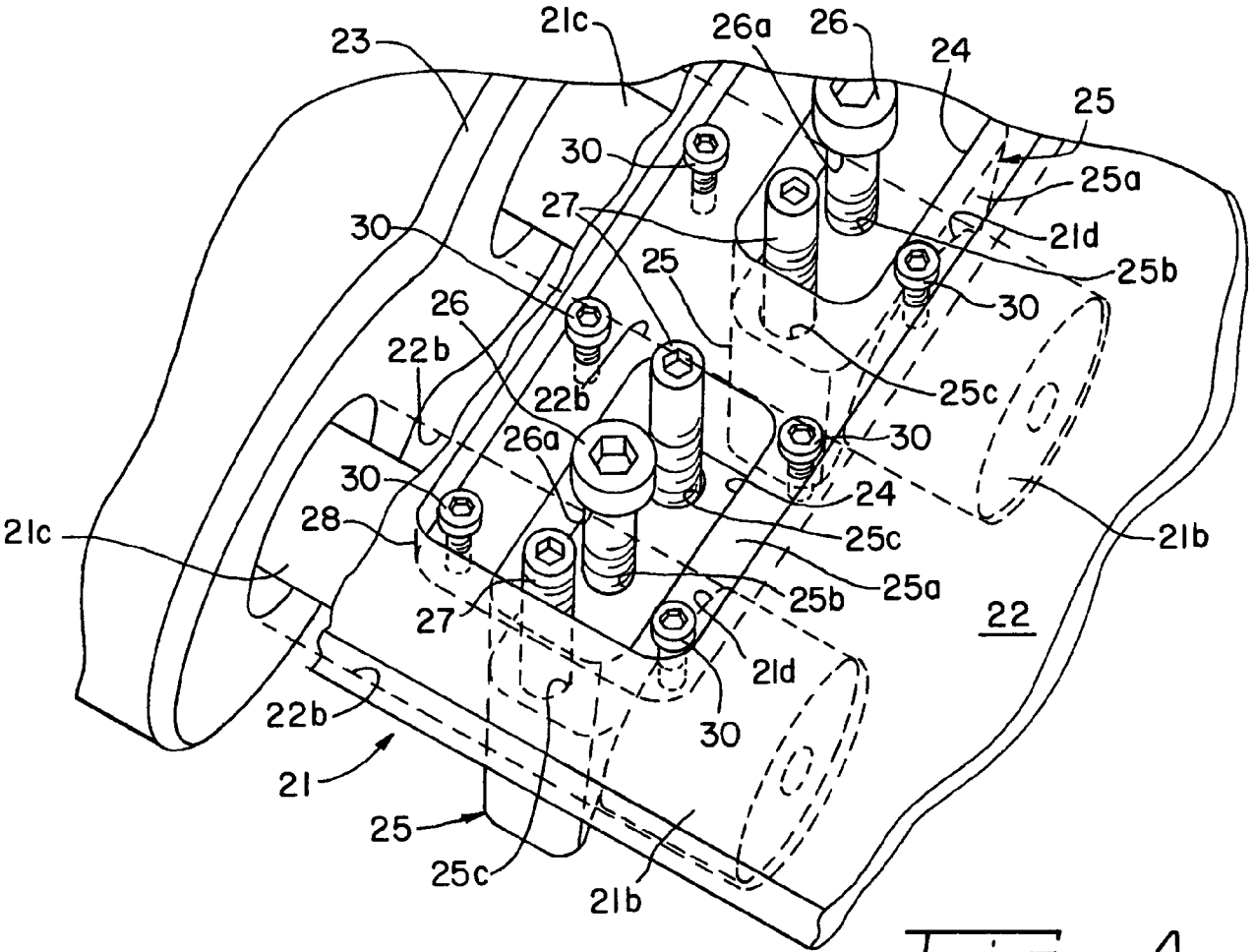

The cylinder-forming die parts 21 and the means for their removable retention in the mold 20 are carried within bank slides 22, which move the cylinder-forming die parts 21 between their retracted position and their extended position, which is shown in FIG. 1. The cylinder-forming die part end portions 21*a* extend into the cavity of the die, as shown in FIG. 1, to form the cylinders of the V-block being cast and are retracted within the mold part 20 to permit the release of a cast V-block from the die. The end portions 21*a* that are adapted to form the cylinders of the internal combustion engine V-block being cast with the use of mold part 20 are not shown in FIGS. 2-5; however, FIGS. 2-5 show the rear proximal portions 21*b* of the cylinder-forming die parts 21. As illustrated in FIGS. 2-5, the proximal portions 21*b* of the mold parts 21 are enlarged compared to their central portions 21*c* and have first surfaces 21*d* (shown in FIG. 2) facing the distal cylinder-forming portions 21*a* of the die part 21. As shown in FIGS. 3-5, a water jacket-forming die piece 23 is connected with the cylinder-forming die parts 21 of the mold part 20 by means not shown. The cylinder-forming die parts 21 move in openings 22*b* (indicated by dashed lines in FIGS. 2 and 4) in the movable bank slide 22 between their extended and retracted positions. As shown in FIGS. 2 and 4, the movable bank slide part 22 includes a series of second openings 24, which lie along axes transversal to, and preferably perpendicular to, the axes of the first openings 22*b*.

As shown in FIG. 4, each of the second openings 24 slidably carries a locking element 25 which is engageable with the first surface 21*d* at the rear of one of the cylinder-forming die parts 21. The locking elements 25 are movable within the second openings 24 between retracted positions which are not shown in FIG. 4, but which would be as a result of movement of the locking elements 25 in the second openings 24 from the locking position shown in FIGS. 3-5, at which the locking elements 25 engage forwardly facing first surfaces 21*d* of the enlarged portions 21*b* at the rear of the cylinder-forming die parts 21, upwardly toward the top of FIGS. 2-5 a distance sufficient that the locking means 25 do not impede the movement of the enlarged rear portions 21*b* of the cylinder-forming mold parts 21 outwardly from the position indicated in FIG. 1, thereby permitting release of the cylinder-forming die parts 21 from the mold part 20. As illustrated by this embodiment, the locking elements 25 can comprise yokes adapted to straddle the central portions 21*c* of the mold elements 21 between their cylinder-forming distal ends 21*a* and their enlarged rear portions 21*b*. As shown in FIGS. 3-5, the rearward faces 25*a* of the locking elements 25 may be tapered for their engagement with the first surfaces 21*d* at the rear of the mold elements 21. The engagement of the locking means 25 and the surfaces of the channel-like openings 24, shown in FIG. 4, holds the locking element 25 in a specified position relative to the bank slide 22 and ensures that the cylinder-forming die end portion 21*a* is retained in its desired position as the bank slide 22 moves the cylinder-forming die part 21 in operation.

As indicated in FIG. 4, each yoke 25 can include a central threaded hole 25*b* and two non-threaded holes 25*c* on each side of the threaded holes 25*b*. The threaded holes 25*b* centrally located in the locking elements 25 pass through the locking members 25 and are threaded their entire lengths through the locking elements 25, but the two non-threaded holes 25*c* of each locking member 25 terminate within the locking elements 25 before passing through the locking elements 25. As shown in FIGS. 3-5, threaded pull screws 26 are engaged with the central threaded holes 25*b* of the locking elements 25, and two push rods 27 are received in each of the non-threaded holes 25*c* of the locking elements 25. As illustrated in FIGS. 3 and 4, a screw retaining cover plate 28 is attached to the movable bank slide 22 by twelve cover plate screws 30, whose positions are indicated in FIG. 5, although FIG. 5 shows neither the screw retaining cover plate 28 or the movable bank slide 22 which the cover plates screws 30 engage. The screw retaining plate 28 remains rigidly attached to the movable bank slide 22 as the locking members 25 are moved from their engagement with the enlarged rear portions 21*b* of the cylinder-forming mold parts 21 toward the screw retaining cover plate 28. As shown in FIGS. 4 and 5, the threaded pull screws 26 have shoulders 26*a* near their tops which are seated on corresponding surfaces (not shown) formed around the unthreaded openings 28*a* in a screw retaining cover plate 28 through which the threaded pull screws 26 pass. The push rods 27, however, are threaded adjacent their upper ends and threadedly engage the holes 28*b* in the cover plate 28 through which they extend.

In removing a cylinder-forming die part 21 from the movable bank slide part 22, the push rods 27 are unthreaded from the threaded holes 28*b* in the screw retaining plate 28, freeing the locking element 25 for that cylinder-forming die part 21 to travel upwardly as the threaded pull screws 26 are rotated in the screw retaining plate 28. Because the engagement of the shoulder 26*a* of the associated pull screw 26 with the screw retaining plate 28 and the rotation of the threaded pull screw 26 within the screw retaining plate 28 and the resulting interaction between the threads of the threaded pull screw 26 and the threads within the threaded hole 25*b* of the locking element 25, the locking element 25 is pulled upwardly and out of engagement with the enlarged end 21*b* and central portion 21*c* of the cylinder-forming die part 21, and the push rods 27 slide upwardly along their unthreaded central portions through the threaded holes 28*b* of the screw retaining plate 28. With the locking element 25 disengaged from the rear portion of the cylinder-forming die part 21, the cylinder-forming die part 21 is free to be removed outwardly from the bank slide 22 and mold part 20 as indicated in FIG. 1 by the arrows 21*e*. As apparent to one skilled in the art, access to the bank slide 22 and the screw retaining plate 28 may be provided by an opening formed in the mold part 20 which may be covered by a plate 20*b* indicated in FIG. 1.

After maintenance, repair or replacement, all or a portion of the cylinder-forming die parts 21 are inserted into the openings 22*b* of the bank slide 22. When a cylinder-forming die part 21 has been seated in the bank slide 22, the threaded pull screw 26 of its locking element 25 is backed out of the locking element 25, and the threaded push rods 27 are used to push the locking element 25 into engagement with the expanded rear portion 21*b* of the cylinder-forming die part 21, and the upper threaded portions of the push rods 27 are threaded into the screw retaining plate 28, forcing the tapered face 25*a* of the locking element 25 into compressed engagement with the forward face 21*d* of the enlarged rear portion 21*b* of the cylinder-forming die part 21. The threaded pull screw 26 is then advanced into the locking element 25 until it no longer extends above the upper surface of the screw retaining plate 28. This procedure is repeated for each cylinder-forming die part removed from the bank slide 22. During the movement of the locking elements 25 between their retracted die part releasing positions and their lower die part retaining positions, the locking elements 25 travel within the channel-like second openings 24 formed in the bank slide 22 by which the cylinder-forming die parts 21 are operated. The portions of the bank slides 22 interfacing the cylinder-forming die parts 21 and the means 25 by which they are removably retained within the bank slide are shown in FIGS. 2 and 4.

While FIGS. 2-5 illustrate the releasable retention of a cylinder-forming die parts 21 with the engagement/disengagement of a yoke 25 as the locking element, and an enlarged rear portion 21*b* of a cylinder-forming die part 21, those skilled in the art will recognize that releasable retention of a cylinder-forming die part can be obtained by the engagement/disengagement of other forms of locking elements and cylinder-forming die parts. For example, a locking element may comprise one or more movably carried pins, threaded or unthreaded, that is/are adapted to mate with a portion of a cylinder-forming die part, such as one or more mating cavities or one or more holes, threaded or unthreaded, formed in the cylinder-forming die part.

Thus, a mold of the invention, part of which is indicated as mold part 20 in FIG. 1, can include a mold element, such as the cylinder-forming mold part 21, that is removably retained within a movable mold part, such as the bank slide 22, relevant portions of which are indicated in FIGS. 2 and 4. The mold element can include a distal portion adapted to form a feature in a mold products formed in the mold, such as the cylinder-forming and water jacket-forming forward portions of the cylinder-forming die part 21, and an enlarged proximal portion having a first surface facing the distal portion, such as the enlarged portion 21*b* with its forward facing surface 21*d* at the rear of the cylinder-forming die part 21. The movable mold part, such as the bank slide 22, can include a first opening, such as opening 22*b* in the bank slide 22 indicated in FIGS. 2 and 4, to receive the removably retained mold element and a second opening arranged internally to transverse the first opening to receive a locking element, such as the channel-like openings 24 formed in the bank slide 22 in a direction orthogonal to the openings 22*b* formed in the bank slide 22. A locking element, such as the yoke 25, is received and movably held within the second opening, such as the channel-like openings 24 shown in the bank slide 22, and can be moved within the second opening between a retracted position, permitting release of the mold element, such as the cylinder-forming mold part 21 from a movable mold part, such as the bank slide 22, and a locking position adapted to engage the first surface of the mold part proximal portion to removably retain the mold element within the movable mold part, for example, as the yoke 25 is moved downwardly (as shown in the drawings) so its tapered surface 25*a* compressively engages the forward facing surfaces 21*d* of the enlarged rear part 21*b* of the cylinder-forming die element 21. The movable mold part also carries means for moving the locking element within the second opening between its retracted position and its locking position, such means being, for example, the screw retaining plate 28, threaded pull screws 26 and threaded push rods 27 shown in FIGS. 3-5.

Further, a method of the invention for maintenance of an internal combustion engine V-block casting die including at least one cylinder-forming die part movably carried by the V-block casting die for reciprocation between a first position extending into the cavity formed by the V-block casting die for formation of the cylinders of a cast V-block and a second position retracted within the V-block casting die, and means for reciprocating the at least one cylinder-forming die part between its first and second positions, can include the steps of providing means for locking the cylinder-forming die part to the means for reciprocating the cylinder-forming die part between its first and second positions, providing access to the locking means from outside of the V-block casting die, disengaging the locking means thereby permitting removal of the cylinder-forming die part from the V-block casting die, and removing the cylinder-forming die part from the V-block casting machine in the direction of its movement between its first and second positions. In a method of the invention the cylinder-forming die part can be moved to its extended first position to be pulled from within the casting die, and/or a force can be applied to the rear of the cylinder-forming die part to remove it from the V-block casting die, and the cylinder-forming die part may be removed from the casting die without removal of the casting die from the die casting machine.

Figure 6:
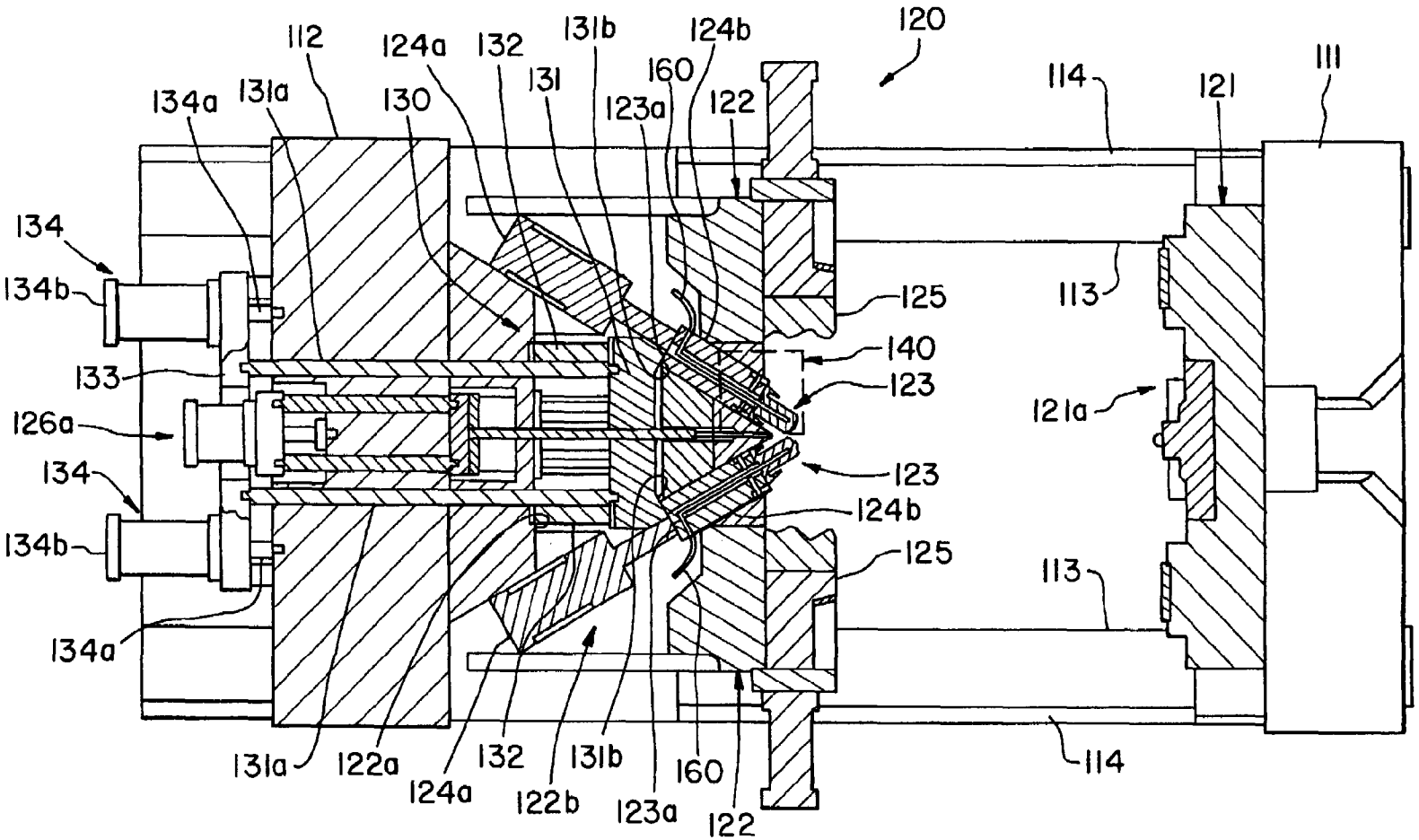
FIG. 6 is an illustration, from above, of a cross-section of a die, including the invention mounted on the stationary and movable platens of a die casting machine in the die open position, with its cylinder-forming die parts in there extended cylinder-forming positions.
Figure 7:
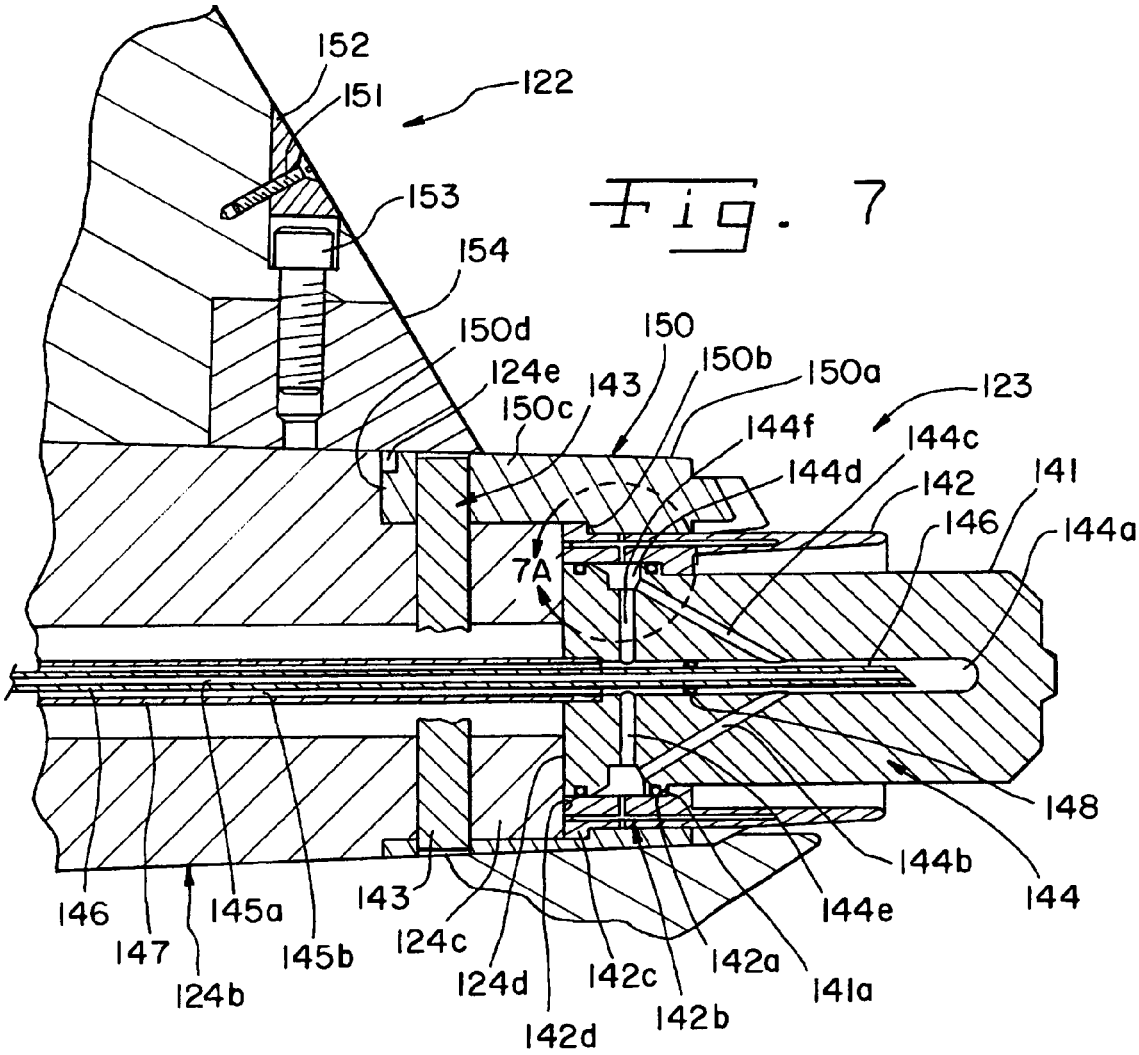
FIG. 7 is an enlarged cross-sectional illustration of the portion of the die of FIG. 6 within the dashed-line box to better illustrate the cylinder-forming die part and the means for its removable retention in the die and FIG. 7A is an enlarged cross-sectional illustration of the portion of FIG. 7 within the circle.

FIGS. 6 and 7 illustrate another exemplary mold or die. FIG. 6 illustrates another die as it may be mounted on a die casting machine. Like the die casting apparatus illustrated in FIG. 1-5, the cylinder-forming die core parts 123 illustrated in FIGS. 6 and 7 are removably retained within the movable die part 122. FIG. 7 is an expanded view of the portion of the apparatus of FIG. 6 within the dashed lined box numbered 140 to better illustrate the cylinder-forming die core part 123 and its removable retention within the movable die part 122.

Referring now to FIG. 6, the die 120 of the invention includes a stationary die element 121 mounted on the stationary platen 111 and a movable die element 122 mounted on the movable platen 112 of the die-casting machine for movement toward and away from the stationary die element 121. A pair of cylinder-forming die core parts 123 (also referred to as "die core pieces 123") are reciprocatably carried in the movable die element 122 at acute angles to the direction of movement of the movable die element 122 toward and away from the stationary die element 121. A pair of hydraulic cylinders 124*a* drive the die core pieces 123 outwardly and inwardly of the movable die element 122 and, respectively, toward and away from the stationary die element 121. As illustrated, the die core pieces 123, and their actuating hydraulic cylinders 124*a*, are enclosed within the movable die element 122. The movable die element 122, and the plurality of die core pieces 123 within it, are carried by the movable platen 112 on the tie bars 113 and side rails 114 of the die-casting machine. FIG. 6, like FIG. 1, illustrates the cavity-forming die (or mold) parts 123 in their forward cylinder-forming positions.

The die 120 includes a plurality of cavity-forming slides 125 that are also carried by the movable die element 122 and are reciprocatable in a direction perpendicular to the direction of movement of the movable die element 122, which is toward and away from the stationary die element 121. When the die is closed, movable die element 122, die core pieces 123, and slides 125 cooperate with a cavity-forming portion 121*a* of the stationary die element 121 to form a cavity for an internal combustion engine V-block.

As known in the art, a part ejector (unnumbered) is carried by the movable die element 122 and is operated by a hydraulic cylinder 126*a* connected between the movable platen 112 and the rearward elements of the part ejector, which are slidably carried in the movable platen 112 and movable die element 122.

A die core locking means 130 is carried by the movable die element 122 and is movable between a first forward position where it engages and locks the die core pieces 123 in their extended cylinder-forming positions, as shown in FIG. 6, and a second rearward position out of engagement with the die core pieces 123.

In a preferred die core locking means 130 illustrated in FIG. 6, a die core locking member 131 is carried within the movable die element 122 and can be actuated by a pair of double-acting hydraulic cylinders 134 connected at one end to the movable platen 112 on which the movable die element 122 is carried, and at the other end to a bar 133 at the rear of the connection rods 131*a* of the die core locking member 131, which are slidably carried by the movable platen 112 and movable die element 122. Although the illustrated embodiment shows the piston element 134*a* engaged with the movable platen 112 and the cylinder 134*b* engaged with the bar 133, other mounting arrangements for the hydraulic cylinder actuators of the die core locking means 130 may be used, e.g., actuators may be carried by the die casting machine for operation of the die core locking means 130.

The die core locking member 131 has a pair of angled wear surfaces 131*b* at its forwardmost end, which engage wear surfaces 123*a* at the rear of the die core pieces 123 when the die core pieces 123 are in their extended positions and the die core locking member 131 is in its forward position, as shown in FIG. 6. In addition, as shown in FIG. 6 a plurality of sliding locks 132 are moved into a position between the rear face of die core locking member 131 and an internal surface 122*a* at the rear of movable die element 122 to hold the die core locking member 131 in engagement with the die core pieces 123 as molten metal is injected under high pressure into the die cavity.

The movable die core element 122 can form an internal cavity 122*b* which carries the die core locking means 130. The cavity 122*b* has an open front position into which the rear ends 123*a* of the die core pieces 123 extend when the die core pieces 123 are in their extended positions, and the die core locking means 130 can move within internal cavity 122*b*, as explained above, from its second rearward position to its first forward position (shown in FIG. 6) where its forwardmost die core engagement surfaces 131*b* abut the rear ends 123*a* of the die core pieces 123. In the preferred embodiment illustrated, the cavity 122*b* encompasses the die core locking member 131 and the locks 132 and provides an internal surface 122*a* that prevents the die core pieces 123 from being moved from their extended cylinder-forming position by the injection pressure of the molten metal when the locks 132 are moved inwardly within the cavity 122*b* between the rear end of the die core locking member 131 and internal surface 122*a*.

As illustrated in FIG. 6, the die core pieces 123 are in their extended, cylinder-forming positions; the die core locking member 131 has moved forwardly to its engagement position with its angled wear surfaces 131*b* at its forwardmost end engaged with wear surfaces 123*a* at the rear of die core pieces 123; and slide locks 132 have moved inwardly between the die core locking member 131 and a rear internal surface 122*a* of the movable die element 122 to hold die core pieces 123 in their extended positions.

As set forth above, FIG. 6 illustrates a die 120 which includes the stationary die element 121 mounted on the stationary platen 111 and the movable die element 122 mounted on the movable platen 112 of a die-casting machine for movement toward and away from the stationary die element 121. The movable die element 122 carries a plurality of transversely moving, cavity-forming slides 125 and at least a pair of cylinder-forming die core parts 123 and means 124*b* for reciprocating the pair of cylinder-forming die parts 123 at an acute angle with respect to the movement of the movable platen 112. The cylinder-forming die core parts 123 are movable between extended positions within the die cavity as shown in FIG. 6 and retracted positions within the movable die part 122. In operation the cylinder-forming die core parts 123 are locked in their extended positions by die core locking means 130 carried by the movable die part 122 as described above. The cylinder-forming die core parts 123 are removably retained within the movable die element 122 as better illustrated in FIG. 7 and described below.

As illustrated in FIG. 7, the cylinder-forming die parts 123 in the embodiment of FIGS. 6 and 7 comprise a cylinder-forming die piece 141 and a water jacket-forming die piece 142 which are adapted to be removed together when the stationary platen and movable platen of die-casting machine are separated. As described above, the cylinder-forming die piece 141 and water jacket-forming die piece 142 may be removed from the movable die 122 from within the cavity by pulling the cylinder-forming die part 123 forwardly or by urging the cylinder-forming die core part 123 forwardly from its rear. Removal of the cylinder-forming die part 123 from the movable die part 122 in either event does not require that the movable die part 122, or any other portion thereof, be removed from the die-casting machine. Where the die core element 123 comprises a cylinder-forming die core piece and a water jacket-forming die core piece, the cylinder-forming die core piece and water jacket-forming die core piece are preferably joined for removal as a unit by an interconnecting means. In the embodiment illustrated in FIG. 7 the cylinder-forming die core piece 141 and water jacket-forming die piece 142 are preferably interconnected by a forwardly facing surface 141*a* of the cylinder-forming die piece 141 and a rearwardly facing surface 142*a* of the water jacket-forming die piece 142, but other equivalent interconnecting means, such as a flexible interconnecting ring (like a snap ring) engaging grooves in the two pieces can be used.

In the embodiment of FIGS. 6 and 7 the cylinder-forming die parts 123 are removably retained within the movable die 122 by locking means accessible from outside the movable die part 122 in a manner similar to the embodiment illustrated in FIGS. 2-5; however, in the embodiment of FIGS. 6 and 7 the locking means comprise pins 143 rather than the yokes of FIGS. 2-5. The pins 143 fasten the cylinder-forming die parts 123 to the means 124*b* for reciprocating the cylinder-forming die parts 123 between their extended and retracted positions in a movable die element 122. The pins 143 may include threaded portions for fastening the cylinder-forming parts 123 to reciprocating means 124*b*.

As further illustrated in FIG. 7, the cylinder-forming die core parts 123 can include means for reducing their temperatures. The temperature reducing means of the cylinder-forming die core parts 123 of FIG. 7 comprise means 144 for conveying coolant within their bodies. In the illustrated embodiment the temperature reducing means can comprise one or more coolant passages, e.g., 145*a* and 145*b*, connectible at the rear of the reciprocating means 124*b* through flexible hoses 160 (FIG. 6) with an external source of coolant. In the illustrated FIG. 7 embodiment coaxial tubes 146 and 147 form the means for delivering coolant from within the internal coolant conduit 145*a* to the coolant-conveying means 144 and from the coolant-conveying means 144 to the coolant conduit 145*b*. In the illustrated embodiment the coolant-conveying means 144 comprises a central coolant passageway 144*a* into which the central tube conduit 146 extends, a pair of passageways 144*b* and 144*c* extending outwardly from the central passageway 144*a* to an annular cavity 144*d* formed around the rear of the cylinder-forming die piece 141 and a pair of passageways 144*e* and 144*f* extending inwardly from the annular cavity 144*d* into the central passageway 144*a* and the passageway 145*b* formed between the rearwardly extending conduits 146 and 147. Because of a seal 148 just forwardly of the passageways 144*e* and 144*f*, the coolant flows outwardly from the cylinder-forming die part 123 through the passageway 145*b* formed between the coaxial conduits 146 and 147. Although not shown in FIGS. 6 and 7, the rigid coolant conduits 146 and 147 may be provided with rearward surfaces that can be used to remove a cavity-forming parts 123 from the movable die element 122 from the rear.

Figure 7A:
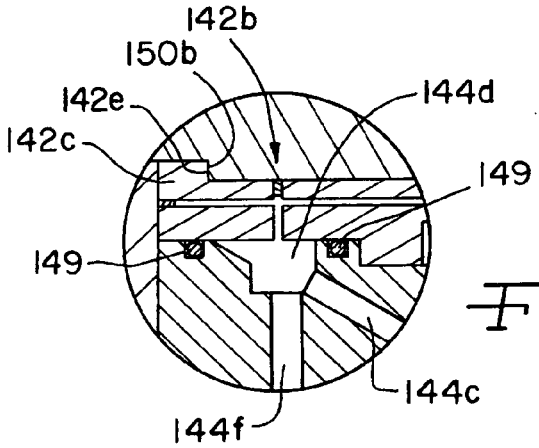

Further illustrated by FIG. 7, the cylinder-forming die parts 123 can also include means for reducing a temperature of the water jacket-forming die pieces 142. Although the water jacket-forming die pieces 142 may be sufficiently cooled by the circulation of coolant through the annular cavity 144*d* adjacent any interfacing inner surface of the water jacket-forming die piece 142, in the embodiment illustrated in FIG. 7 the water jacket-forming die piece 142 is also provided with inner coolant passages 142*b* in communication with the annular coolant cavity 144*d* formed at the outer surface of the cylinder-forming die piece 141. Where the cylinder-forming die core piece 141 includes one or more coolant passageways 144*a*, 144*b*, 144*c* and 144*d* and has an outer surface portion which is in heat transfer engagement with the water jacket-forming die piece 142, the temperature of the water jacket-forming die piece 142 may be substantially reduced, but where the water jacket-forming die piece 142 comprises one or more interior coolant passageways, e.g. 142*b*, in communication with the coolant passageways of die core piece 141 as shown in FIGS. 7 and 7A, the temperature of the water jacket-forming die piece 142 can be even further reduced. A pair of high temperature seals 149 seal the interface between the cylinder-forming die piece 141 and the water jacket-forming die piece 141 as shown in FIG. 7A.

Thus, a cylinder-forming die part 123 for V-block casting die is adapted to be removably retained in a V-block casting die. The cylinder-forming die part 123 can comprise a cylinder-forming die piece 141 and water jacket-forming die piece 142 adapted to be moved together within the V-block casting die in the direction of their central axis by a reciprocating means 124*b* and separated for individual maintenance, repair or replacement on their removal from the V-block casting die 122. The cylinder-forming die piece 141 and water jacket-forming die piece 142 are interconnected so they may be removed together, for example, by a forwardly facing surface 141*a* of the cylinder-forming die piece 141 and rearwardly facing surface 142*a* of the water jacket-forming die piece 142, although other means can be used to interconnect the cylinder-forming die piece 141 and water jacket-forming die piece 142 for removal together. The cylinder-forming die part 123 is adapted at its rear to be removably connected with means 124*b* for reciprocating it in the direction of its central axis, and a cylinder-forming die piece 141 and water jacket-forming die piece 142 can be adapted at their rears to be removably connected with at least one interconnecting element 150, described below, included in the means 124*b* for moving them together in the direction of their central axes. In the embodiment illustrated in FIG. 7 the water jacket-forming die piece 142 includes a flange 142*c* at its rear providing a rearwardly facing annular surface 142*d* and a forwardly facing annular surface 142*e* (FIG. 7A), which mates with a rearwardly facing surface 150*b* of the interconnecting element 150 of the means 124*b* for reciprocating the cylinder-forming die part 123. The interconnecting element 150 can comprise a first cylindrical element 150 with a forward portion 150*a* that surrounds the water jacket-forming die piece 142 and has a rearwardly facing annular surface 150*b* engaged with the forwardly facing annular surface 142*e* of the water jacket-forming die piece 142. The first cylindrical element 150 further has a rearward portion 150*c* adapted to be removably locked, for example, by pin 143, with the means 124*b* for moving the cylinder-forming die piece 141 and water jacket-forming die piece 142 in the direction of their central axes. As illustrated by FIG. 7, the forward portion of the means 124*b* for reciprocating the cylinder-forming die piece 141 and water jacket-forming die piece 142 can comprise a forward portion 124*c* extending into the first cylindrical element 150 and being adapted to be engaged with, and removably locked to, the first cylindrical element 150 whereby removal of the pin 143 permits the first cylindrical element 150 to be removed forwardly from the movable die element 122 so that the first cylindrical element 150, water jacket-forming die piece 142 and cylinder-forming die piece 141 may be separated for individual maintenance repair or replacement. Preferably, the forward portion 124*c* of the reciprocating means 124*b* includes a forwardly facing surface 124*d* engaged with the rearwardly facing surface 142*d* of the water jacket-forming die piece 142 and with the rear surface 141*b* of the cylinder-forming die piece 141 and further includes a second forwardly facing surface 124*e* engaged with the second annular rearwardly facing surface 150*d* of the first cylindrical element 150.

As indicated in FIG. 7, access to the pin 143 by which the cylinder-forming die part 123 is removably retained within the movable die 122 may be obtained by removal of screw 151, cover plate 152, threaded fastener 153 and cover block 154. Where pin 143 comprises a screw-like fastener threaded into the reciprocating means 124*b*, fastener 143 may be accessed by a screw removal tool, such as allen wrench or screw driver, and removed from the assembly permitting cylindrical element 150, water jacket-forming die piece 142 and cylinder-forming die piece 142 to be pulled forwardly from the die without removal of any other portion of the die from the die casting machine.

Figure 8:
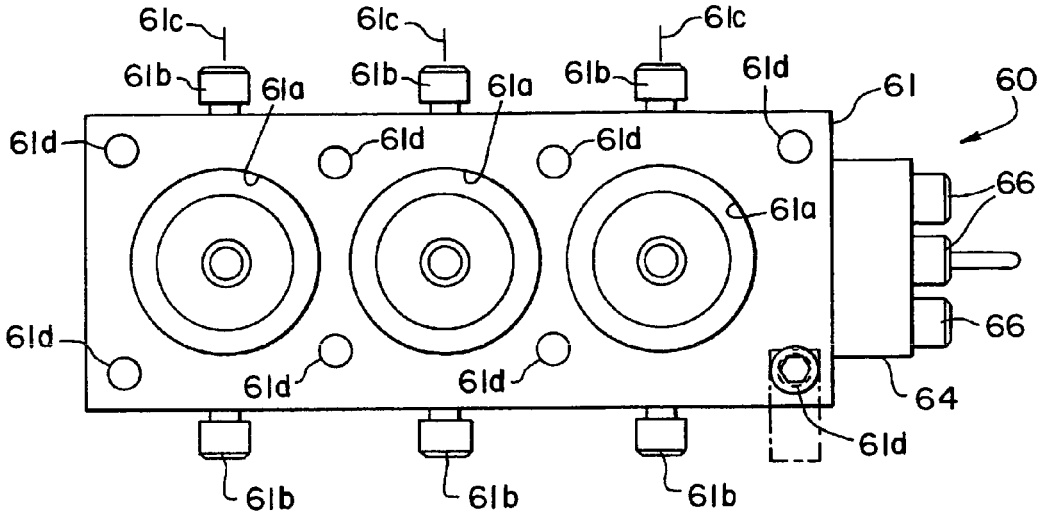
FIGS. 8-10 are three orthogonal views of tool for removal of cylinder-forming die parts from a mold, FIG. 8 being a view from above the tool, FIG. 9 being a view from the side of the tool, and FIG. 10 being a view from the end of the tool.
Figure 9:
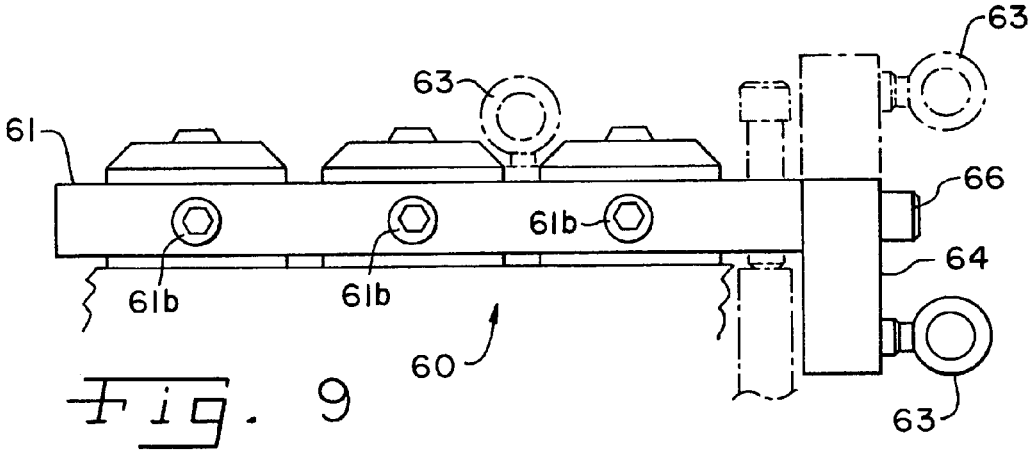
Figure 10:
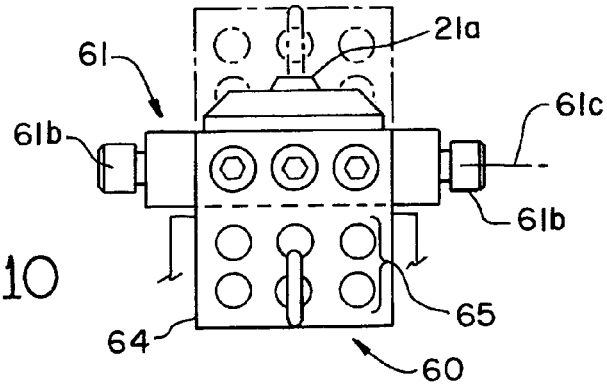

FIGS. 8-10 illustrate a tool 60 for extracting cylinder-forming die parts from a V-block casting die. As illustrated in FIGS. 8-10 the tool 60 comprises means 61 to at least partially encompass and engage a one or more cylinder-forming die parts, such as 21 or 123 (FIGS. 1 and 6).

The means 61 preferably encompasses the cylinder-forming die piece of a cylinder-forming die part because of the water jacket-forming die piece is generally thin-walled and more likely to be damaged from its engagement by a removal tool than the cylinder-forming die piece; however, if the water jacket-forming die piece is strong and rigid the means 61 can be adapted to encompass and engage the water jacket-forming die piece.

As illustrated by FIG. 8, the means 61 of the tool 60 includes a plurality of openings 61*a* that encompass or at least partially encompass, for example, the three cylinder-forming die elements 21*a* of a 6-cylinder V-block casting die, shown in FIG. 1. It will be apparent to those skilled in the art that the means 61 can include any number of encompassing or partially encompassing openings 61*a*. The means 61 also carries a plurality of threaded members 61*b* in a plurality of threaded holes that lie on axes 61*c* that pass through the centers of the plurality of openings 61*a*. The threaded members 61*b*, when turned, may compressively engage the cylinder-forming die pieces 21*a* of the cylinder-forming die part 21 and permit the cylinder-forming die part 21 to be pulled outwardly from the V-block casting die for examination, maintenance, repair or replacement. While threaded members 61*b* may only be required on one side of the means 61, the provision of threaded members on both sides of means 61 permits the tool 60 to be more conveniently used for removal of the cylinder-forming die parts of both the left and right banks of cylinder-forming die parts. To assist in pulling the cylinder-forming die pieces 21, from the V-block casting die, the means 61 can be provided with a plurality of threaded holes 61*d* to accept one or more eyebolts (shown in dashed lines in FIG. 9 as eyebolt 63). The threaded holes 61*d* can also accept a plurality of threaded rods, such as allen-headed bolts, that can urge the cylinder-forming die part 21 from the V-block casting die as they are threaded into the means 61. The means 61 may also include a bolted on, outwardly-extending flange 64 provided with a plurality of threaded openings 65 to permit the attachment of tethering means to restrain the uncontrolled drop of the cylinder-forming parts upon their release from the die, which may be unexpected. An unrestrained falling of the cylinder-forming die parts, which are heavy and may have injury-causing surfaces, can injure the maintenance or repair personnel and can damage the die parts. With the flange 64 bolted to the means 61, for example, by bolts 66, it can be fastened to extend in either direction from the means 61. The flange 64 permits connection of the tool 60 and the removed cylinder-forming die parts by means of an eyebolt 63 to an overhead crane or the die casting machine or another structural member.

While FIGS. 8-10 illustrate the means 61 in the form of a relatively thick plate with a plurality of holes 61*a* for encompassing plural cylinder-forming die pieces 21*a* of a cylinder-forming die part 21 and compressively engaging the plural cylinder-forming die pieces 21*a* with a plurality of threaded members 61*b*, the means 61 can be formed with a single opening or a series of partially encompassing openings to be fitted on the cylinder-forming die pieces of a cylinder-forming die part and can be provided with a one or more part-engaging elements carried by the means 61 to engage the cylinder-forming die pieces 21*a* of cylinder-forming die parts by either moving the one or more elements into engagement with the cylinder-forming die pieces or by providing the elements with sharpened and hardened ends for biting into the surfaces of the cylinder-forming die pieces, or means 61 can itself be deformed by compression of its opposed sides to compressively engage the cylinder-forming die pieces. In this latter form of the means 61, the internal surfaces forming the opening or openings that engage the cylinder-forming die pieces can be provided with non-slip surfaces for engagement with the cylinder-forming die pieces.

While the invention has been illustrated and described with respect to the best currently known embodiments, those skilled in the art will recognize that other modes, variations and embodiments are possible within the scope of the invention as set forth in the following claims.

We claim:

1. A die for casting a V-block for an internal combustion engine in a die-casting machine having a stationary platen and a movable platen, comprising:

a stationary die element for mounting on the stationary platen of the die casting machine, and a movable die element for mounting on the movable platen of the die-casting machine, said movable die element carrying a plurality of transversely movable, cavity-forming slides and at least a pair of cylinder-forming die parts removably retained in means for reciprocating the pair of cylinder-forming die parts at an acute angle with respect to the movement of the movable platen between extended positions within the die cavity and retracted positions within the movable die element, each of said at least a pair of cylinder-forming die parts having a rearward portion providing an engagable surface, locking elements carried within, and accessible from outside of, said reciprocating means, engaging the engagable rearward portions of the cylinder-forming die parts for removably retaining said cylinder-forming die parts in said reciprocating means, and die core locking means for locking the cylinder-forming die parts in their extended positions.

2. The die of claim 1, wherein said locking elements comprise threaded fastener pins.

3. The die of claim 2, wherein the pins include threaded portions threadedly engaged with the means for reciprocating the cylinder-forming die parts.

4. The die of claim 1, wherein the locking elements are movably carried within the reciprocating means between a locking engagement and an unlocking disengagement with the cylinder-forming die parts.

5. The die of claim 4, wherein the cylinder-forming die parts include portions extending rearwardly from their cylinder-forming portions with engagable portions adjacent their rears, and the locking elements are movably carried by the reciprocating means between locking positions in which they engage the engagable portions of the cylinder-forming die parts in the reciprocating means, and retracted positions in which they are disengaged from the engagable portions of the cylinder-forming die parts, permitting the cylinder-forming die parts to be removed from the die.

6. The die of claim 5, wherein the cylinder-forming die parts include rearwardly extending rods and the engagable portions of the cylinder-forming die parts comprise rod portions adjacent the rear of the rods that are larger than the rods and smaller than the cylinder-forming die parts, and the locking elements comprise yokes shaped and located to engage the rod portions in their locking positions.

7. The die of claim 1 wherein the die core locking means are movably carried by operation of the die into locking engagement with the cylinder-forming die parts in their extended positions.

8. The die of claim 7, wherein the die core locking means comprises a die core locking member reciprocatably carried along the axis of movement of the movable platen and operable in its forwardmost position to engage rear portions of the cylinder-forming die parts and lock the cylinder-forming die parts in their extended positions.

9. A die for casting a V-block for an internal combustion engine in a die-casting machine having a stationary platen and a movable platen, comprising:

a stationary die element for mounting on the stationary platen of the die casting machine, and a movable die element for mounting on the movable platen of the die-casting machine, said movable die element carrying a plurality of transversely movable, cavity-forming slides and at least a pair of cylinder-forming die parts, and means for reciprocating the at least a pair of cylinder-forming die parts at an acute angle with respect to the movement of the movable platen between extended positions within the die cavity and retracted positions within the movable die element, said cylinder-forming die parts being removably held in said movable die element by rearward engagable portions within the means for reciprocating the at least a pair of cylinder-forming die parts and holding elements movably carried by the reciprocating means between holding positions in which they engage the rearward engagable portions of the cylinder-forming die parts and releasing positions in which they are disengaged from the rearward engagable portions of the cylinder-forming die parts.

10. The die of claim 9, wherein at least one of said cylinder-forming parts comprises cylinder-forming and water jacket-forming die pieces adapted to be removed together when the stationary platen and movable platen at the die-casting machine are separated.

11. The die of claim 10, wherein the at least one cylinder-forming die core part includes means for reducing the temperature of the water jacket-forming die piece.

12. The die of claim 11, wherein cylinder-forming die core pieces of the cylinder-forming die parts convey coolant adjacent portions of their outer surfaces, and the attached water jacket-forming die core pieces have interior surfaces that interface with said outer surface portions of the cylinder-forming die core pieces.

13. The die of claim 9, wherein the cylinder-forming die parts are removably held in the movable die element by holding elements accessible from outside of the movable die element.

14. The die of claim 13, wherein said holding elements comprises pins including threaded portions for fastening the cylinder-forming die parts to their reciprocating means.

15. The die of claim 9, wherein the cylinder-forming die parts include portions extending rearwardly from their cylinder-forming portions with engagable portions adjacent their rears, and the holding elements are movably carried by the reciprocating means between holding positions in which they engage the engagable portions of the cylinder-forming die parts in the reciprocating means and releasing positions in which they are disengaged from the engagable portions of the cylinder-forming die parts, permitting the cylinder-forming die parts be removed from the die.

16. The die of claim 15, wherein the cylinder-forming die parts include rearwardly extending rods, and the engagable portions of the cylinder-forming die parts comprise rod portions adjacent the rear of the rods that are larger than the rods and smaller than the cylinder-forming die parts, and the holding elements comprise yokes shaped and located to engage the forward portions of the rod portions in their holding positions.

17. The die of claim 9, wherein the cylinder-forming die parts include one or more coolant passageways connectable with an external source of coolant.

18. The die of claim 17, wherein one or more tubular conduits for coolant are connected at the rear of the movable die element and provide a rearward surface that can be used to remove the cavity-forming die parts from the movable die element.

* * * * *